US005841011A

United States Patent [19]

Hashimoto et al.

[11] Patent Number: 5,841,011

[45] Date of Patent: Nov. 24, 1998

[54] PROCESS FOR PRODUCING LIGHT-WEIGHT OIL FROM WASTE PLASTICS CONTAINING PHTHALIC POLYESTER AND/OR POLYVINYL CHLORIDE

[75] Inventors: Kenji Hashimoto, Tsuzuki-gun; Takao Masuda, Kyoto; Shuichi Yoshida, Handa; Yuichi Ikeda, Nagoya, all of Japan

[73] Assignees: Kenji Hashimoto; NGK Insulators, Ltd, both of Japan

[21] Appl. No.: 776,763

[22] PCT Filed: Jun. 6, 1996

[86] PCT No.: PCT/JP96/01542

§ 371 Date: Feb. 6, 1997

§ 102(e) Date: Feb. 6, 1997

[87] PCT Pub. No.: WO96/40839

PCT Pub. Date: Dec. 19, 1996

[30] Foreign Application Priority Data

Jun. 7, 1995 [JP] Japan ..... 7-140621

[51] Int. Cl.[6] ..... C07C 1/00

[52] U.S. Cl. ..... 585/241; 585/832; 585/469; 585/638; 585/733; 208/400; 201/2.5; 201/25

[58] Field of Search ..... 585/241, 832, 585/469, 638, 733; 208/400, 130, 131; 201/2.5, 25

[56] References Cited

U.S. PATENT DOCUMENTS

| | | | |
|---|---|---|---|
| 4,851,601 | 7/1989 | Fukuda et al. | 585/241 |
| 4,982,027 | 1/1991 | Korff et al. | 585/241 |
| 5,079,385 | 1/1992 | Wu | 585/241 |
| 5,321,174 | 6/1994 | Evans et al. | 585/241 |
| 5,364,995 | 11/1994 | Kirkwood et al. | 585/241 |
| 5,639,937 | 6/1997 | Hover et al. | 585/241 |

FOREIGN PATENT DOCUMENTS

| | | |
|---|---|---|
| WO 9503375 A | 2/1995 | Germany . |
| 48-36276 | 5/1973 | Japan . |
| 48-65280 | 9/1973 | Japan . |
| 49-21480 | 2/1974 | Japan . |
| 51-129473 | 11/1976 | Japan . |
| 5-237467 | 9/1993 | Japan . |
| 5-345894 | 12/1993 | Japan . |

OTHER PUBLICATIONS

7th Asian Pacific Confederation Chem. Eng., vol. 1, pp. 94–98 (1996).

*Primary Examiner*—Bekir L. Yildirim
*Attorney, Agent, or Firm*—Parkhurst & Wendel, L.L.P

[57] ABSTRACT

Light-weight oil having a high octane number is produced from waste plastics containing phthalic polyester and/or polyvinyl chloride at a high yield without producing a phthalic sublimate or a carbonaceous residue by pyrolyzing the waste plastics in an atmosphere of steam or a steam/inert gas mixture. The resulting pyrolyzed oil and pyrolyzed gas may be catalytically cracked in an atmosphere of steam or a steam/inert gas mixture. Dechlorination may be performed before pyrolysis is carried out. Pyrolysis is preferably carried out in the presence of at least one of iron hydroxide, hydrous iron oxide and iron oxide.

20 Claims, 10 Drawing Sheets

PROCESS FOR PRODUCING LIGHT-WEIGHT OIL FROM WASTE PLASTICS CONTAINING PHTHALIC POLYESTER AND/OR POLYVINYL CHLORIDE

TECHNICAL FIELD TO WHICH THE INVENTION BELONGS

The present invention relates to a process for producing light-weight oil having a high octane number at a high yield from waste plastics containing phthalic polyester and/or polyvinyl chloride, without producing a phthalic sublimate or a carbonaceous residue, by pyrolyzing the waste plastics containing phthalic polyester and/or polyvinyl chloride.

PRIOR ART

It is known that the waste plastics are ordinarily composed mainly of polyolefinic plastics such as polyethylene and polypropylene, polystyrene, polyvinyl chloride or phthalic polyester. Various processes are proposed for producing light-weight oil having a high octane number of not less than 100, such as gasoline, at not less than 50 wt % with respect to the waste plastics as a part of the chemical recycling by breaking the above polyolefinic plastic into pieces, and effecting pyrolysis or catalytic cracking after dechlorination if necessary (For example, see JP-A-63 178195, JP-A-3 86790 and JP-A-86791).

However, if phthalic polyester and/or polyvinyl chloride containing a phthalic plasticizer is mixed in the waste plastics, there is a problem that a large amount of a phthalic sublimate and a carbon residue are produced during the pyrolysis, which cause a producing apparatus to be clogged. In order to solve this problem, it is necessary to preliminarily separate and remove the phthalic polyester and/or the polyvinyl chloride from the waste plastics, which causes a problem that the waste plastics-treating procedure becomes complicated.

On the other hand, as described in JP-A-6 220,463 and JP-A-7 82,569, there is a proposal that light-weight oil is produced from waste plastics containing polyvinyl chloride. The former publication has a problem that it is an indispensable requirement to use a material having an amide group, which raises costs and cannot be simply applied to the treatment of the waste plastics as municipal waste. Further, the latter case has a problem that since a phthalic sublimate produced during the pyrolysis is saponified, the yield of a product oil decreases.

PROBLEM TO BE SOLVED BY THE PRESENT INVENTION

The present invention is to solve the above-mentioned conventional problems, and has been accomplished to provide a process for producing light-weight oil from waste plastics containing phthalic polyester and/or polyvinyl chloride, which process can almost eliminate the production of a phthalic sublimate and a carbonaceous residue during a pyrolysis step and produce light-weight oil having a high octane number at a high yield even in the case of waste plastics containing phthalic polyester and/or polyvinyl chloride including a phthalic plasticizer.

The process for producing light-weight oil from waste plastics containing a phthalic polyester and/or a polyvinyl chloride according to the present invention has been accomplished to solve the above problems, and is characterized in that the light-weight oil is produced by pyrolyzing the waste plastics containing the phthalic polyester and/or the polyvinyl chloride in an atmosphere of steam or a mixture of steam and an inert gas.

Since almost none of the phthalic sublimate and the carbonaceous residue are produced in the pyrolysis step of the waste plastics containing phthalic polyester and/or polyvinyl chloride according to the present invention, a pipe line can be prevented from being clogged. Further, since the light-weight oil having a high octane number to be used as a raw material for obtaining gasoline and the like can be obtained at a high yield from the waste plastics, this enables the waste plastics to be recycled without being thrown away, and also enables effective utilization of resources.

PREFERRED EMBODIMENTS OF THE PRESENT INVENTION

The present invention will be explained in more detail below.

I. Pyrolysis step

Figure 1:
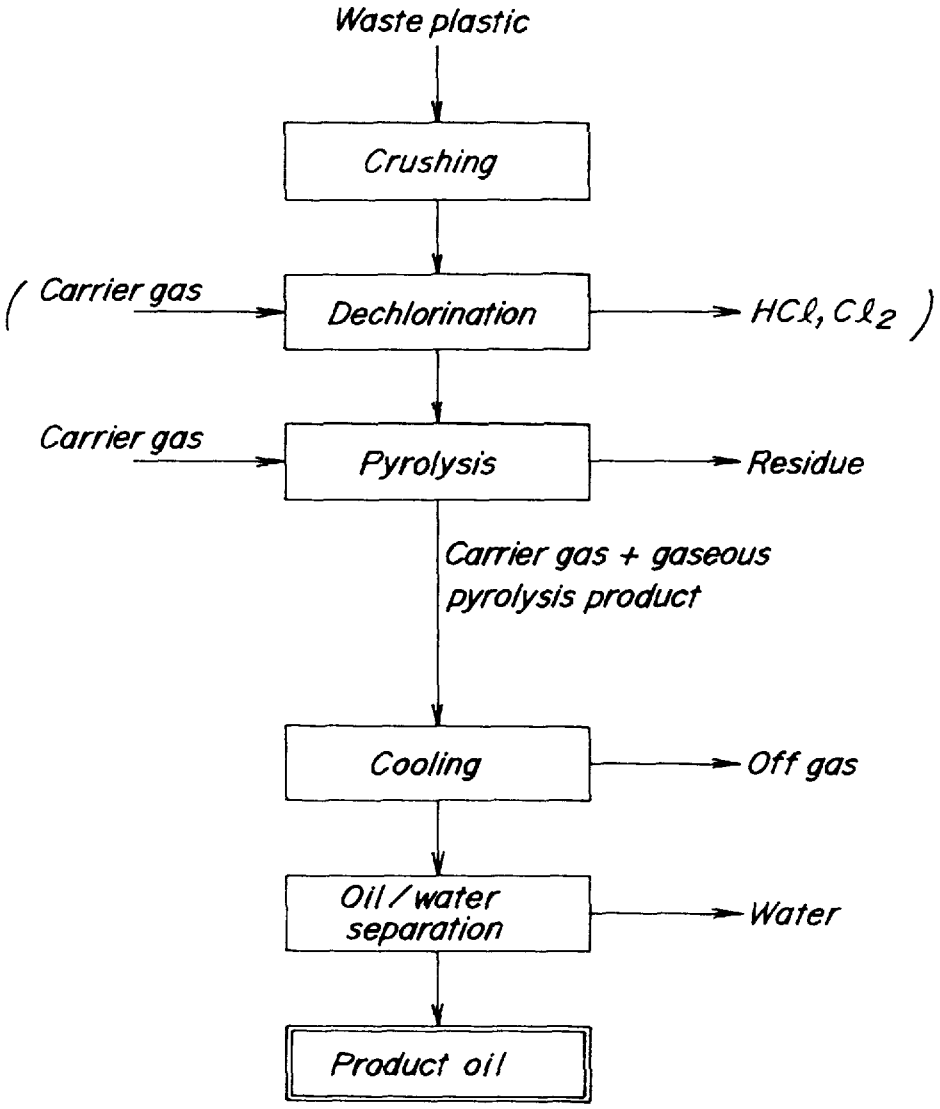
FIG. 1 shows a flow chart of a process for the production of light-weight oil from the waste plastics containing phthalic polyester and/or polyvinyl chloride according to the present invention, including a pyrolysis step.

FIG. 1 shows a flow chart of the process for the production of light-weight oil from the waste plastics containing phthalic polyester and/or polyvinyl chloride, including a pyrolysis step. It is shown that a dechlorinating step parenthesized in the following figure is carried out if necessary. The waste plastics is crushed in given sizes by a conventional method, and crushed waste plastics pieces are pyrolyzed in an atmosphere of steam or a mixture of steam and an inert gas, thereby obtaining light-weight oil. The pyrolysis is ordinarily performed at a pyrolysis temperature of 350° to 550° C. under ordinary pressure as a pyrolysis pressure. The pyrolysis reaction may be performed by a given pyrolysis reactor in a batch system, or may be performed while the waste plastics, steam and the inert gas (carrier gas) are being fed at given feed rates.

The atmosphere in the pyrolysis reaction may be steam alone. However, considering that hot steam is a little dangerous, a mixed gas of steam and an inert gas is preferred as the atmosphere. Although the mixing ratio between the steam and the inert gas is not particularly limited, the concentration of steam in the mixed gas is preferably 10 to 100% from the standpoint of suppressing the production of the carbonaceous residue. As the inert gas, nitrogen, a combustion exhaust gas of a pyrolyzed gas obtained in the pyrolysis step or the like may be used. The pyrolysis reaction time is determined by taking into consideration the pyrolysis temperature, the scale of the pyrolysis such as the amount of the waste plastics, etc.

The waste plastics to which the process of the present invention may be applied contain phthalic polyester and/or polyvinyl chloride. The ratio between the phthalic polyester and/or the polyvinyl chloride in the waste plastics is not limited to a particular range. The invention process may be also applied to waste plastics containing another plastic or resin such as polyethylene resin. The phthalic polyester here means polyesters of phthalic acid and terephthalic acid, represented by polyethylene phthalate, polybutylene phthalate, polyethylene terephthalate and polybutylene terephthalate.

The light-weight oil obtained by the pyrolysis varies to some extent depending upon a reaction condition, etc., and is composed of a gasoline component, light oil, kerosine, heavy oil, etc. For example, the gasoline component is contained in an amount of about 20 wt %. The light-weight oil produced in the pyrolysis is gaseous at the pyrolysis temperature, taken out from the pyrolysis reactor together with an atmosphere gas or a carrier gas, and liquefied and recovered by being cooled with water or air (cooled with water in an embodiment in FIG. 1). According to the invention process, the amount of the carbonaceous residue produced in the pyrolysis reaction can be suppressed to a very low level, for example, down to not more than about 1%. Further, according to the invention process, the waste plastics may be cracked to benzene without producing a phthalic sublimate (mainly phthalic acid, terephthalic acid and phthalic anhydride). The gas not liquefied even by cooling is composed of methane, ethane, propane, butane, etc. and is recovered as an off gas or discarded. The light-weight oil liquefied by cooling with water is divided into water and oil, and the light-weight oil is recovered as a product oil, whereas water is recycled in the process.

It is preferable that the pyrolysis is performed in a pyrolysis reactor filled with a solid filler, for example, glass beads, granular ceramic such as alumina or the like. In this case, heat is effectively transferred from the solid filler having a large heat capacity and a large contact area to the crushed waste plastics.

Further, the pyrolysis reaction is preferably performed in the presence of one or more kinds of iron hydroxide, hydrous iron oxide, iron oxide and iron ore as a catalyst. In this case, the catalyst itself may be charged in a granular or pellet form into the pyrolysis reactor instead of or in addition to the above solid filler. Alternatively, the catalyst may be charged into the pyrolysis reactor in the state that the catalyst is carried on the surface of the solid filler. The oxidation numbers of iron hydroxide, hydrous iron oxide and iron oxide mentioned above are three, but a certain amount of compounds having bivalent iron may be contained. The use of one or more kinds of iron hydroxide, hydrous iron oxide, iron oxide and iron ore mentioned above as the catalyst can promote the transfer of the heat and to more smoothly advance the pyrolysis as mentioned before. In the present specification, the pyrolysis reactor filled with the solid filler and/or the catalyst is called a trickle bed pyrolysis reactor.

It may be that the waste plastics is pyrolyzed without being pyrolyzed in the presence of the catalyst, and a gaseous pyrolyzed product obtained by the pyrolysis is taken out to a reactor which is separately provided from the pyrolysis reactor and filled with the above catalyst and in which the phthalic sublimate is pyrolyzed to benzene or the like. In the present specification, this reactor is called a phthalic sublimate pyrolysis reactor. As to the catalyst, the same physical properties and filling method as mentioned above may be used. Ordinarily, the reaction temperature is 350° to 550° C., and the reaction pressure is ordinary pressure. The sublimate in a gaseous form is fed into the sublimate reactor together with the pyrolyzed gas carrier, and cracked to benzene or the like. In this way, the phthalic sublimate may be pyrolyzed in the phthalic sublimate pyrolysis reactor separately provided from the above pyrolysis reactor, the phthalic sublimate is preferably pyrolyzed in the trickle bed pyrolysis reactor as mentioned above from the standpoint of the heat efficiency.

Since the residue is attached to the filler or the catalyst filled in the pyrolysis reactor or the phthalic sublimate pyrolysis reactor with the lapse of time to reduce the heat transmission efficiency or the catalytic activity, the filler or the catalyst may be taken out of the reactor at an appropriate time, and returned to the reactor after the residue is removed. By so doing, since the filler or the catalyst is regenerated and repeatedly circulated and recycled, natural source can be saved.

In the above invention process in which the pyrolysis including a hydrolysis reaction is performed in the atmosphere of steam or steam and the inert gas, the carbonaceous residue can be reduced to about 1 to 2% of the phthalic polyester and/or the polyvinyl chloride fed, whereas the carbonaceous residue is produced in an amount of about 20% of the phthalic polyester resin fed in a conventional process in which nitrogen gas is used as a carrier gas. Further, as mentioned above, the pyrolysis reaction is preferably carried out in the filled type pyrolysis reactor from the standpoint of the catalytic efficiency between steam and plastic. When the waste plastics is pyrolyzed in the presence of one or more kinds of iron hydroxide, hydrous iron oxide, iron oxide and iron ore as a catalyst, the phthalic sublimate produced during the pyrolysis can be cracked to oil.

II Dechlorination step

Figure 2:
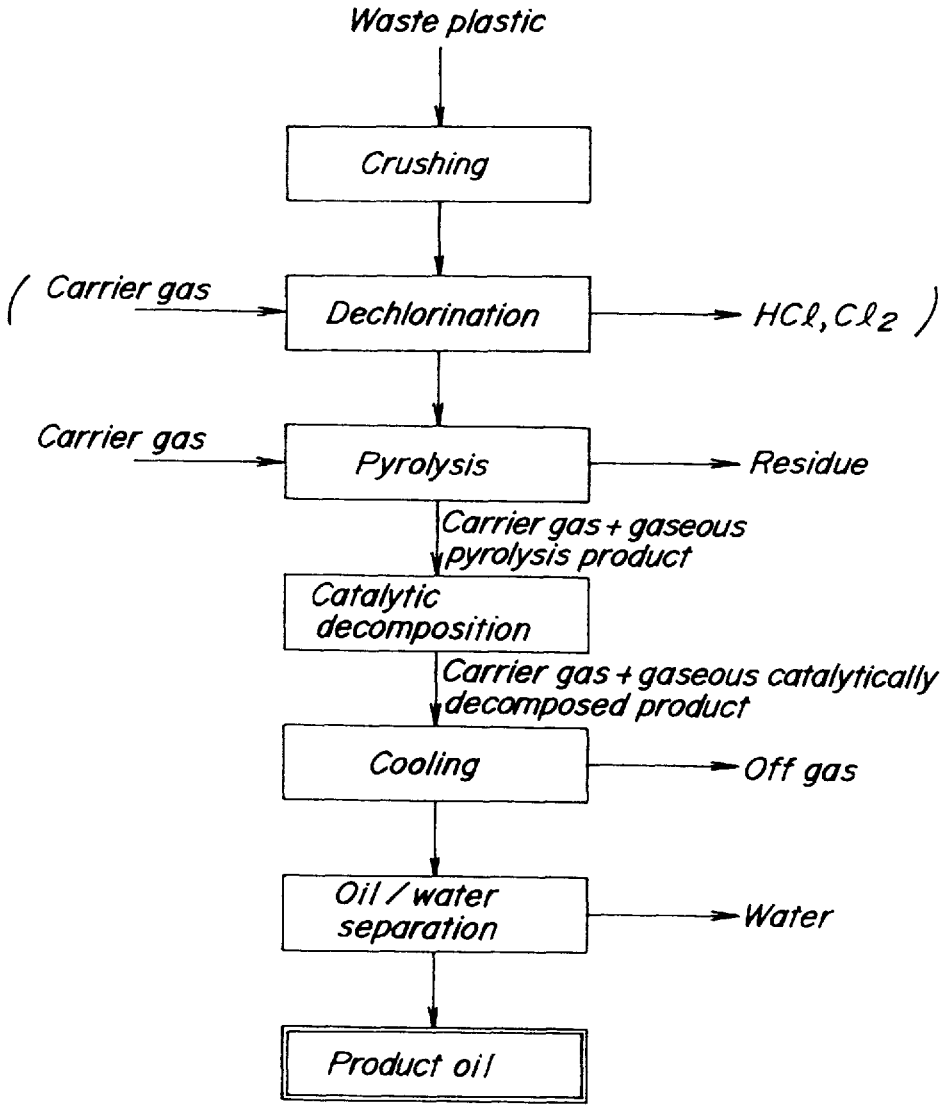
FIG. 2 shows a flow chart of a process for the production of light-weight oil from the waste plastics containing phthalic polyester and/or polyvinyl chloride according to the present invention, including a dechlorinating step, a pyrolysis step and a catalytic cracking step.

With respect to the waste plastics in which the polyvinyl chloride is mixed, the dechlorination step is preferably effected before the pyrolysis step. FIG. 2 shows a flow chart of the invention process in which light-weight oil is produced from the waste plastics containing phthalic polyester and/or polyvinyl chloride. The dechlorination is effected to remove poisonous gases such as hydrogen chloride and to facilitate a post treatment, and is ordinarily operated at 200°–350° C. in the atmosphere of steam or steam and an inert gas inside a dechlorinating reactor under ordinary pressure. The dechlorination reaction may be operated in a given dechlorinating pyrolysis reactor in a batch system or while the waste plastics, steam and the inert gas (carrier gas) are being fed at given feed rates.

The atmosphere in the dechlorination reaction may be steam alone, but it is preferably a mixed gas of steam and the inert gas, considering that hot steam is a little dangerous. The mixing ratio between steam and the inert gas in the mixed gas is not particularly limited. As the insert gas, nitrogen gas or a combustion exhaust gas of the pyrolyzed gas produced in the pyrolysis step may be used. The dechlorinating reaction time is determined, while the dechlorination reaction temperature, the declination reaction scale such as the amount of waste plastics, etc. are considered. In the dechlorination reaction, chlorine contained in the waste plastics is discharged off outside in the form of HCl and $Cl_2$ together with the atmosphere gas or the carrier gas.

The dechlorinating reaction is preferably operated in a dechlorinating reactor filled with a solid filler, for example, glass beads, granular ceramic such as alumina or the like. In this case, heat is effectively transferred from the solid filler having a large heat capacity to the crushed waste plastics having a larger contact area. The waste plastics from which chlorine is removed is led to the pyrolysis step where it is treated in the same manner as shown in FIG. 1. When the dechlorination is operated in the dechlorinating reactor filled with the solid filler, it may be that the waste plastics and the filler are transferred to the pyrolysis reactor where the pyrolysis is completed, the filler is taken out from the pyrolysis reactor together with the residue, and the filler is fed to the dechlorinating reactor again after it is regenerated by removing the residue. Thus, the filler may be circulated between the dechlorinating reactor and the pyrolysis reactor for recycling.

III Catalytic cracking step

As mentioned above, although the pyrolyzed oil obtained in the above pyrolysis step (which may include a case where the dechlorinating step is operated before the pyrolysis step if necessary or include the above sublimate cracking step) varies to some extent depending upon the reacting condition, etc. , the pyrolyzed oil includes gasoline component, light oil, the pyrolyzed oil and the pyrolyzed gas kerosine, heavy oil, etc. In order to increase the rate of the gasoline component, the pyrolyzed oil or the pyrolyzed oil and the pyrolyzed gas produced in the pyrolysis step is catalytically cracked in an atmosphere of steam or steam and inert gas by using a catalyst. Thereby, light-weight oil having a higher rate of the gasoline component can be obtained. See FIG. 2. In the light-weight oil obtained in the catalytic cracking reaction, the yield of the gasoline component is for example about 70 wt %, and the remainder is composed of carbon and pyrolyzed gases such as methane, ethane, propane and butane.

The "light-weight oil" used in the present specification includes both the light-weight oil obtained by the pyrolysis reaction and that obtained by the pyrolysis reaction and catalyst cracking reaction. The catalytic cracking reaction is ordinarily operated at a pyrolysis temperature of 300° to 600° C. under ordinary pressure as the pyrolysis pressure. The catalytic cracking reaction is effected in the state that the gaseous pyrolyzed oil or the gaseous pyrolyzed oil and the pyrolyzed gas as well as steam and inert gas (carrier gas) are being fed at given feed rates. The atmosphere in the catalytic cracking reaction may be steam alone, but a mixed gas of steam and the inert gas is preferred, considering that hot steam is a little dangerous.

The mixed ratio between steam and the inert gas in the mixed gas is not particularly limited. Further, the catalytic cracking reaction time is determined, while the catalytic cracking temperature, the catalytic cracking scale such as the amounts of the gaseous pyrolyzed oil or the gaseous pyrolyzed oil and the pyrolyzed gas, etc. are considered. As the catalyst used in the catalytic step, a catalyst in which a rare earth metal is introduced into Y-type zeolite is preferably used. Y-type zeolite supporting a transition metal may be used as the catalyst. As the transition metal, nickel is preferred. The light-weight oil produced in the catalytic cracking, which is gaseous at the pyrolysis temperature, is taken out from the catalytic cracking reactor together with the atmosphere gas or the carrier gas and liquefied and recovered by being cooled with water or air cooled with water in the embodiment of FIG. 2.

The gas not liquefied even by cooling includes methane, ethane, propane, butane, etc., and is recovered or discarded as an off gas. The light-weight oil is divided into water and oil, cooled with water in the embodiment of water and oil, and the light-weight oil is recovered as a product oil, whereas water is recycled in the process. If a catalyst in which a rare earth metal is exchanged into Y-type zeolite and nickel is supported thereon is used, the gasoline component is produced at a yield of not less than about 70 wt %. An off gas coming out after the above pyrolysis step (FIG. 1) and the catalytic cracking step (FIG. 2) may be used as a heat source, for example, for producing steam to be used as the atmosphere gas or the carrier gas.

Figure 3:
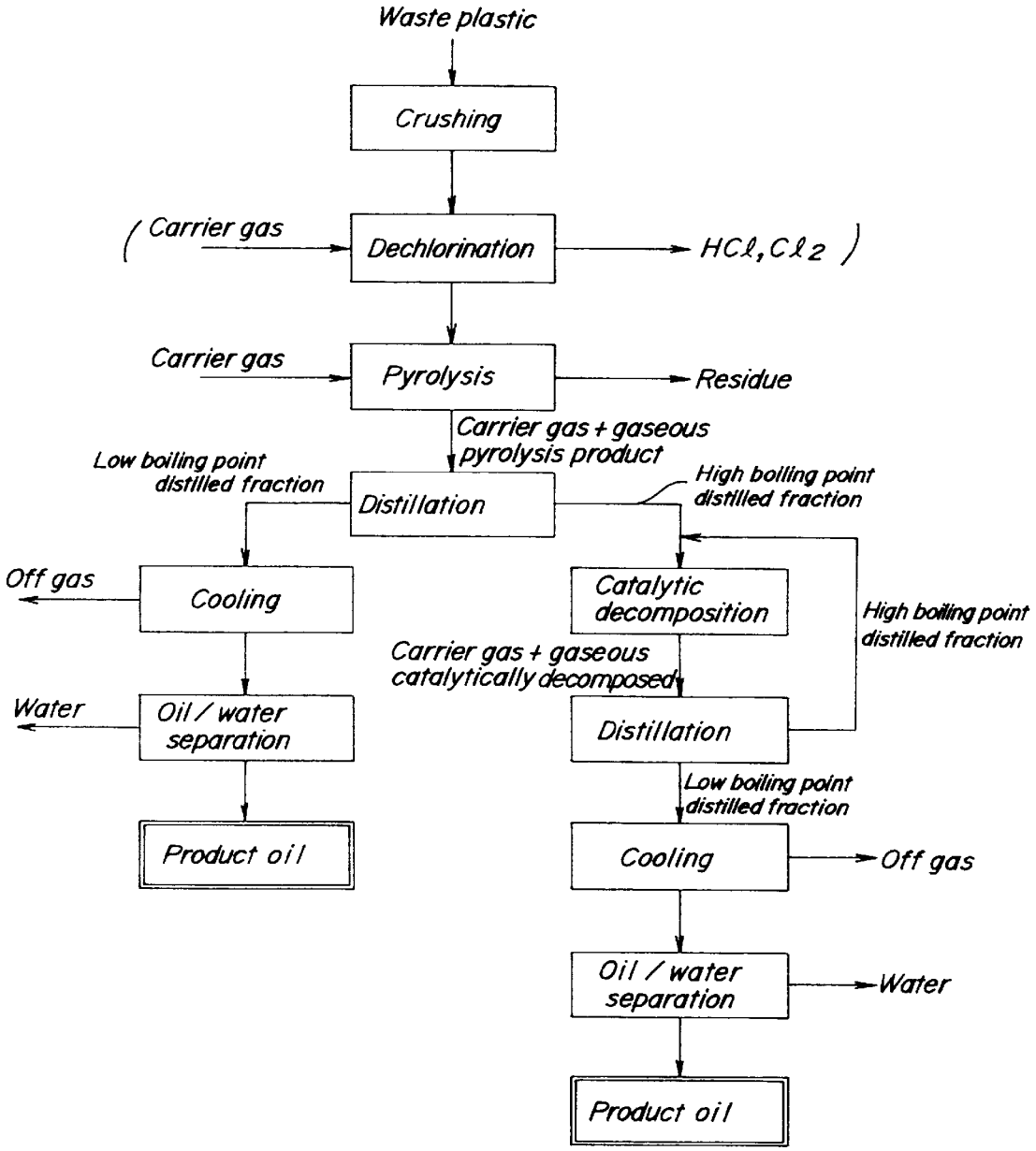
FIG. 3 shows a flow chart of a process for the production of light-weight oil from the waste plastics containing phthalic polyester and/or polyvinyl chloride according to the present invention, including a dechlorinating step, a pyrolysis step, a distilling step and a catalytic cracking step.

FIG. 3 shows a flow chart of another embodiment of the process for producing light-weight oil from the plastic containing phthalic plastic and/or polyvinyl chloride according to the present invention. After a dechlorinating reaction is performed if necessary and then the pyrolysis is carried out, the reaction product is divided into a low boiling point fraction and a high boiling point fraction by distillation. The low boiling point fraction is treated in the same manner as shown above in FIG. 1 to obtain a product oil, whereas only the high boiling point fraction is catalytically cracked in an atmosphere of steam or steam and an inert gas to obtain a product oil in the same treatment as in FIG. 2. In this case, after following the catalytic cracking, the product oil is divided into a low boiling point fraction and a high boiling point fraction, the high boiling point fraction only may be catalytically cracked again. In this embodiment, the light-weight oil can be produced at a high yield.

Figure 4:
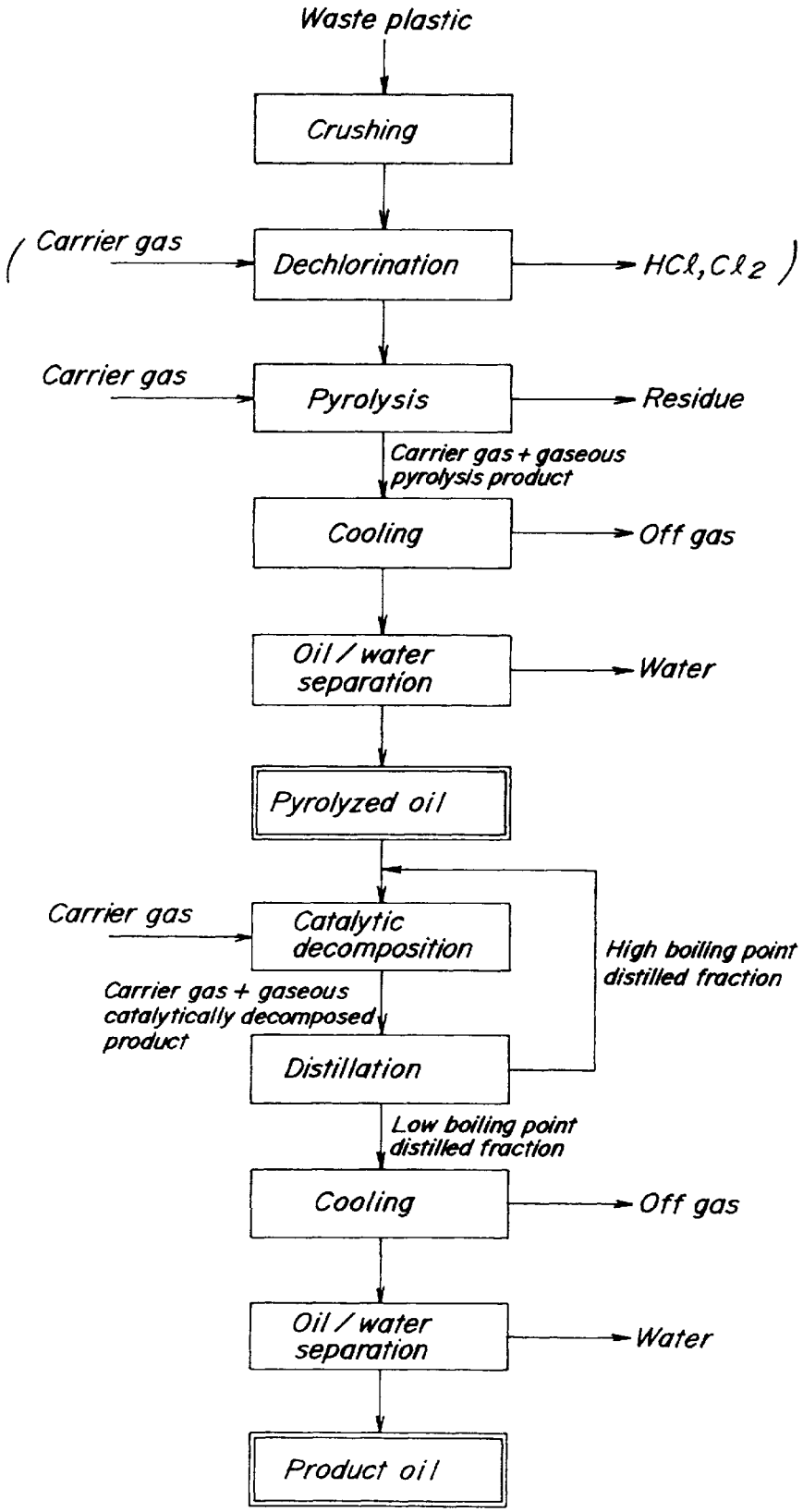
FIG. 4 shows another embodiment of the process for the production of a product oil by obtaining a pyrolyzed oil through cooling a gaseous pyrolyzed product produced in a pyrolysis step and separating oil and water and catalytically cracking the pyrolyzed oil according to the present invention.

FIG. 4 shows a further embodiment of the invention process for producing a product oil by catalytically cracking a pyrolyzed oil obtained through subjecting a gaseous pyrolyzed product produced in a pyrolysis step to cooling and oil/water separation. In this case, the pyrolyzed oils obtained in the above are collected, and altogether subjected to the catalytic cracking, so that the light-weight oil can be effectively produced.

Figure 5:
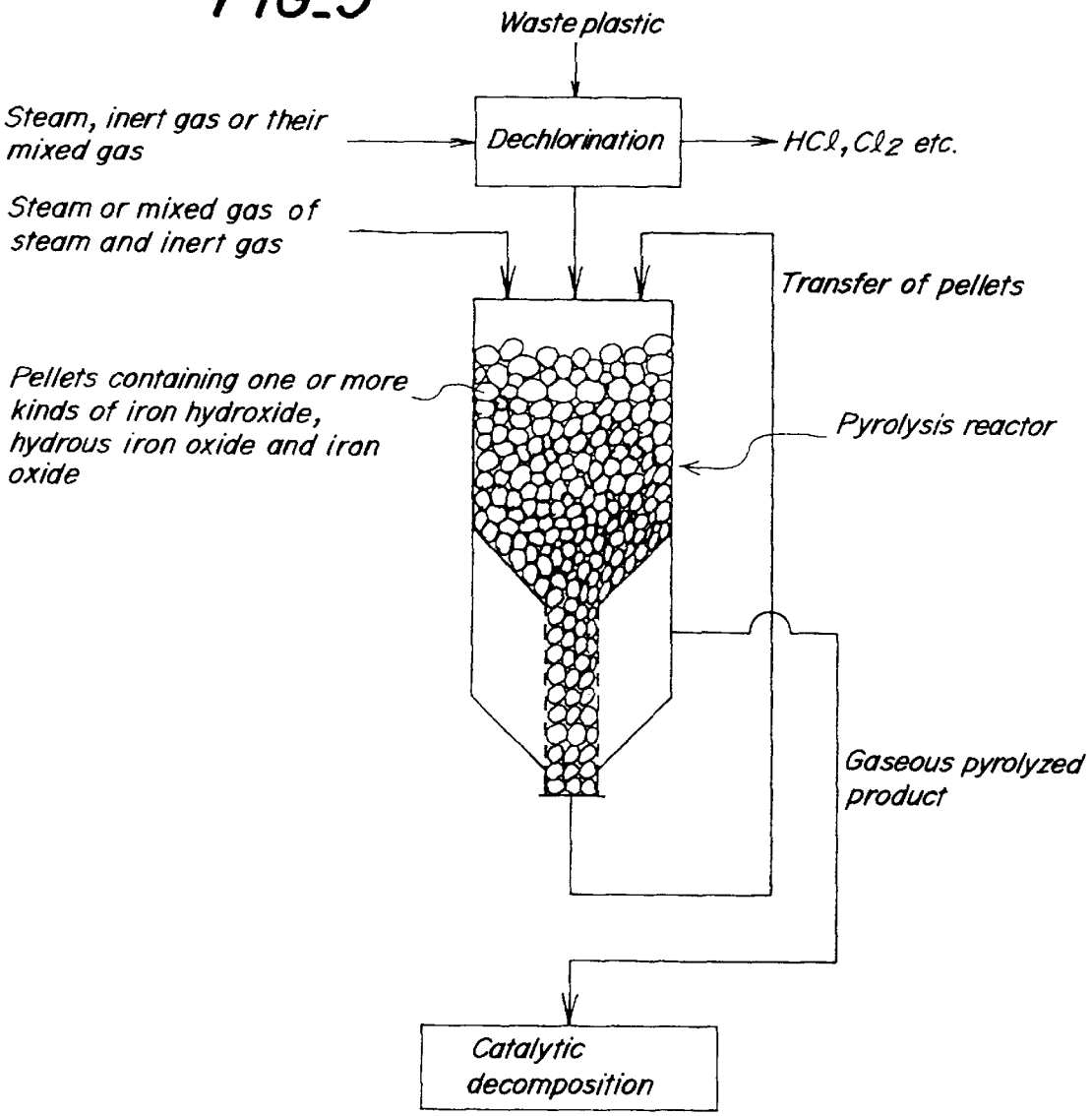
FIGS. 5 through 7 show other embodiments of the process for the production of light-weight oil from the waste plastics containing phthalic polyester and/or polyvinyl chloride according to the present invention.
Figure 6:
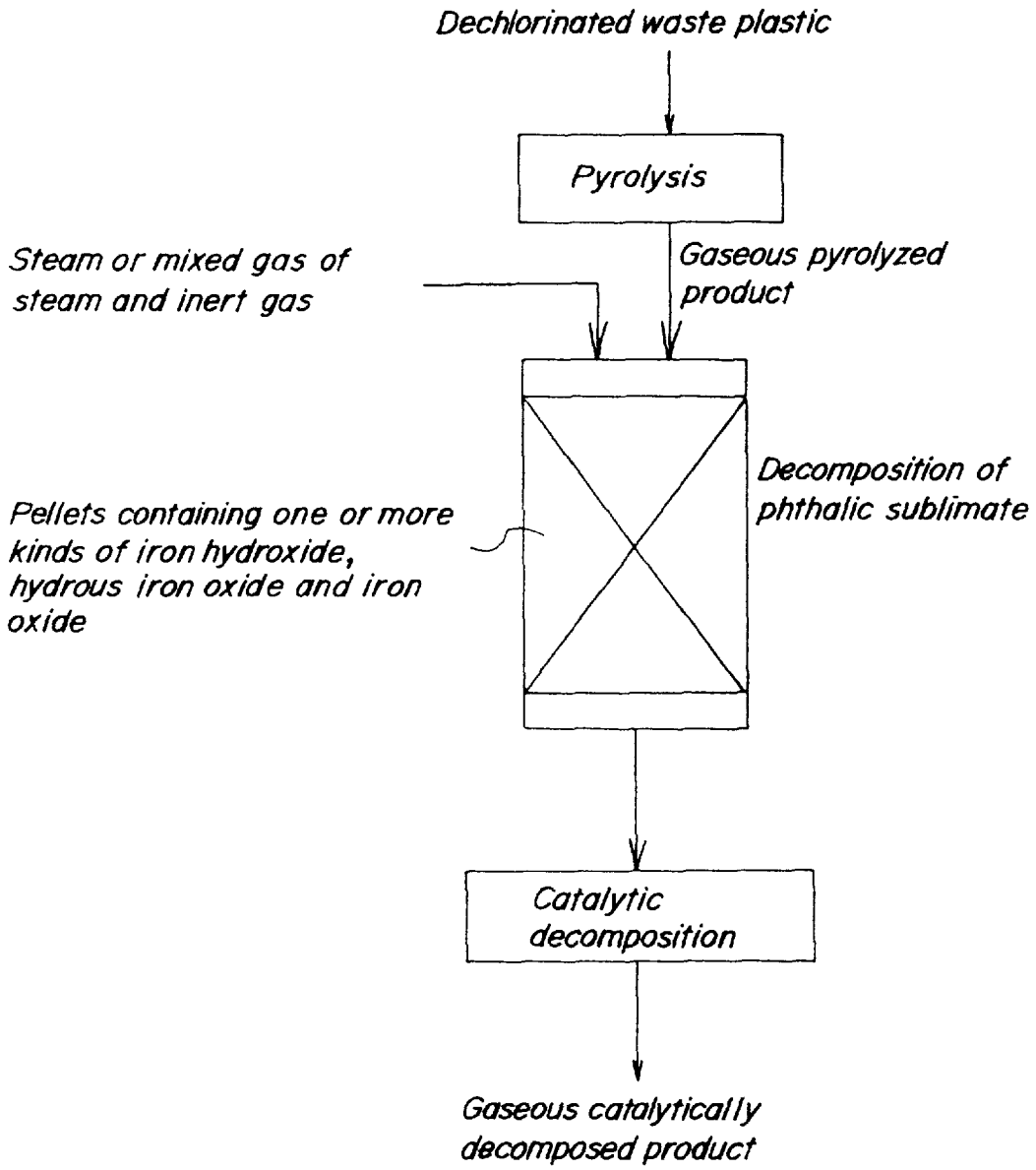
Figure 7:
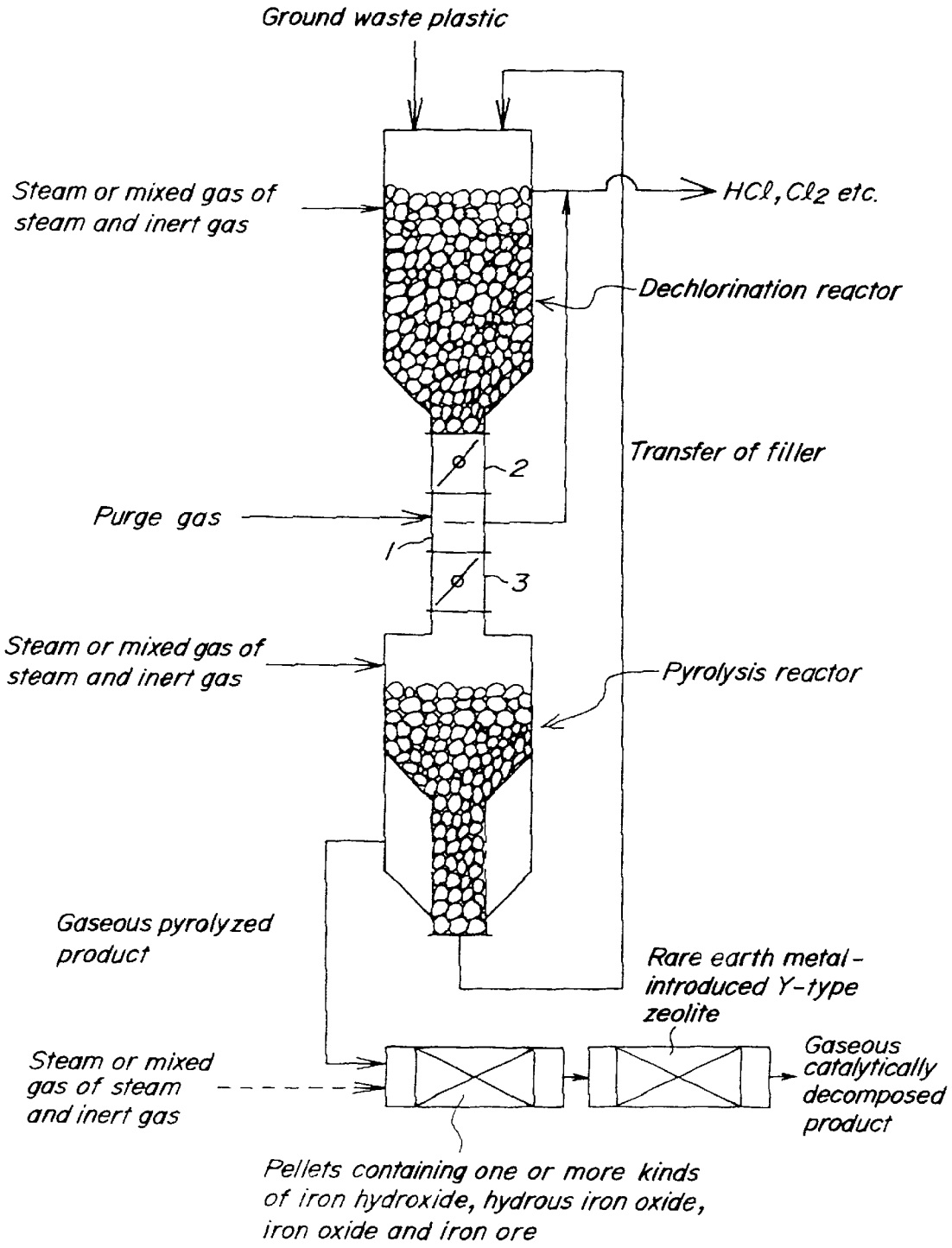

FIG. 5 to FIG. 7 show still further embodiments of the present invention. In FIG. 5, after dechlorination is performed if necessary, waste plastics is fed to a filled type pyrolysis reactor in which are charged pellets of a catalyst composed of one or more kinds of iron hydroxide, hydrous iron oxide, iron oxide and iron ore or pellets containing or carrying the above catalyst, steam or a mixed gas of steam and an inert gas is fed, preferably in a parallel flow, to the pyrolysis reactor from an upper side, and a gaseous pyrolyzed product is taken out together with the steam or the mixed gas of the steam and the inert gas for effecting catalytic cracking, whereas the pellets are successively taken out from the filled type pyrolysis reactor from a lower side and regenerated pellets are returned to the pyrolysis reactor from the upper side after material attached to the pellets is removed.

FIG. 6 shows an embodiment in which besides the above pyrolysis step, a phthalic sublimate is cracked between the pyrolysis step and the catalytic contact step. In a phthalic sublimate cracking reactor are charged pellets of a catalyst composed of one or more kinds of iron hydroxide, hydrous iron oxide, iron oxide and iron ore or pellets containing or carrying the above catalyst, and steam or a mixed gas of steam and an inert gas is fed to the reactor from an upper side, whereas a gaseous pyrolyzed product produced is taken out together with steam or the like for effecting the catalytic cracking.

In FIG. 7, a staying section 1 for a dechlorinated waste plastics is provided between a dechlorinating reactor and a pyrolysis reactor, and an upper portion of the waste plastics-staying section 1 is connected to a bottom of the dechlorinating reactor via an on/off valve 2, whereas a lower portion of the waste plastics-staying section 1 is connected to an upper portion of the pyrolysis reactor via an on/off valve 3.

In this embodiment, a filler is used commonly in the dechlorinating reactor and the pyrolysis reactor. While a carrier gas of steam or steam and the inert gas is first being fed with the on/off valve 2 being closed, the waste plastics is dechlorinated in the dechlorinated reactor. Then, after feeding of the carrier gas is stopped and the on/off valve 2 is opened, a given amount of the filler and the molten waste plastics is dropped into the waste plastics-staying section 1 in the state that the on/off valve 3 is closed. Next, the on/off valve 2 is closed, and a purge gas is flown to purge hydrogen chloride, etc. remaining on the filler and the molten waste plastics. Thereafter, the on/off valve 3 is opened to lead the filler and the molten waste plastics after the dechlorination to the pyrolysis reactor, and the on/off valve 3 is closed.

A gaseous pyrolyzed oil cracked in the pyrolysis reactor is led, together with the carrier gas, to a phthalic sublimate cracking reactor in which are charged pellets of the catalyst composed of one or more kinds of iron hydroxide, hydrous iron oxide, iron oxide and iron ore or pellets containing or carrying said catalyst. In this reactor, the phthalic sublimate is cracked in an atmosphere of steam or a mixed gas of steam and an inert gas, and a gaseous cracked product is subjected to catalytic cracking.

In the embodiments in FIG. 5 to FIG. 7, since the pyrolysis reaction and the phthalic sublimate cracking reaction are operated by using the pellets of the catalyst composed of one or more kinds of iron hydroxide, hydrous iron oxide, iron oxide and iron ore or the pellets containing or carrying said catalyst, the phthalic sublimate is cracked to benzene, etc. to prevent the treating apparatus in the present invention from being clogged. Consequently, the process for producing the light-weight oil from the waste plastics containing phthalic polyester and/or polyvinyl chloride according to the present invention can be smoothly and effectively practiced. In the embodiments of FIG. 4 and FIG. 6, the natural source can be saved and the cost can be reduced by regenerating and recycling the filler in the same manner as mentioned before.

Example 1

A product oil was obtained by treating waste plastics composed of 100% polyethylene terephthalate resin in the procedure shown in FIG. 1 by using a trickle bed pyrolysis reactor having a filler of glass beads as a pyrolysis reactor. The percentage of carbonaceous residue produced was not more than 1% for each of a case where steam was used alone as a carrier gas and a case where 60 mol % of steam and 40 mol % of nitrogen gas were used as the carrier gas. To the contrary, the percentage of the carbonaceous residue was 17% in a conventional process where nitrogen gas was used alone. It was confirmed that the production of the carbonaceous residue could be assuredly prevented by the invention process, although the polyethylene terephthalate resin was contained as a starting material. Further, the product oil included carbon dioxides having high addition values, such as aldehydes, ethers, ketones, alcohols, aromatic compounds. In this example, the feed rate of the carrier gas was set at 123 cc/min., and the reaction temperature was 450° C.

Example 2

A product oil was obtained by treating waste plastics composed of 93 wt % of polyethylene resin and 7 wt % of polyethylene terephthalate resin, of which composition ratio was near to that of the general waste, in the procedure shown in FIG. 3 by using a trickle bed pyrolysis reactor filled with glass beads as a pyrolysis reactor. As a carrier gas in the pyrolysis, 60 mol % of steam and 40 mol % of nitrogen gas were used, and a feed rate was set at 123 cc/min and the pyrolysis was carried out at 450° C. The percentage of carbonaceous residue produced was not more than 1%. A distilled fraction in a high boiling point range of 200° to 300° C. was distilled. As a carrier gas in a catalytic cracking, 50 mol % of steam and 50 mol % of nitrogen gas were used, and a pyrolyzed oil was fed at a rate of 1 g/h per 1 g of a catalyst. Furthermore, a catalyst of rare earth metal exchanged Y-type zeolite supporting nickel was used as a trickle bed, and a reaction temperature was set at 400° C. under ordinary pressure.

The yield of the light-weight oil with respect to the pyrolyzed oil was 70 wt %, and its octane number was 110. The oil was composed of 70 wt % of saturated hydrocarbons and 30 wt % of aromatic hydrocarbons. In a conventional process (Example 1 of JP-A-3 86,790), the octane number was 98.8, and saturated hydrocarbons were 40 wt %, and aromatic hydrocarbons were about 60 wt %. The yield was 64% based on plastic fed. It was confirmed that the invention process had excellent effects that the octane value was higher, and the content of a gasoline component was greater.

Examples 3 to 5

Figure 8:
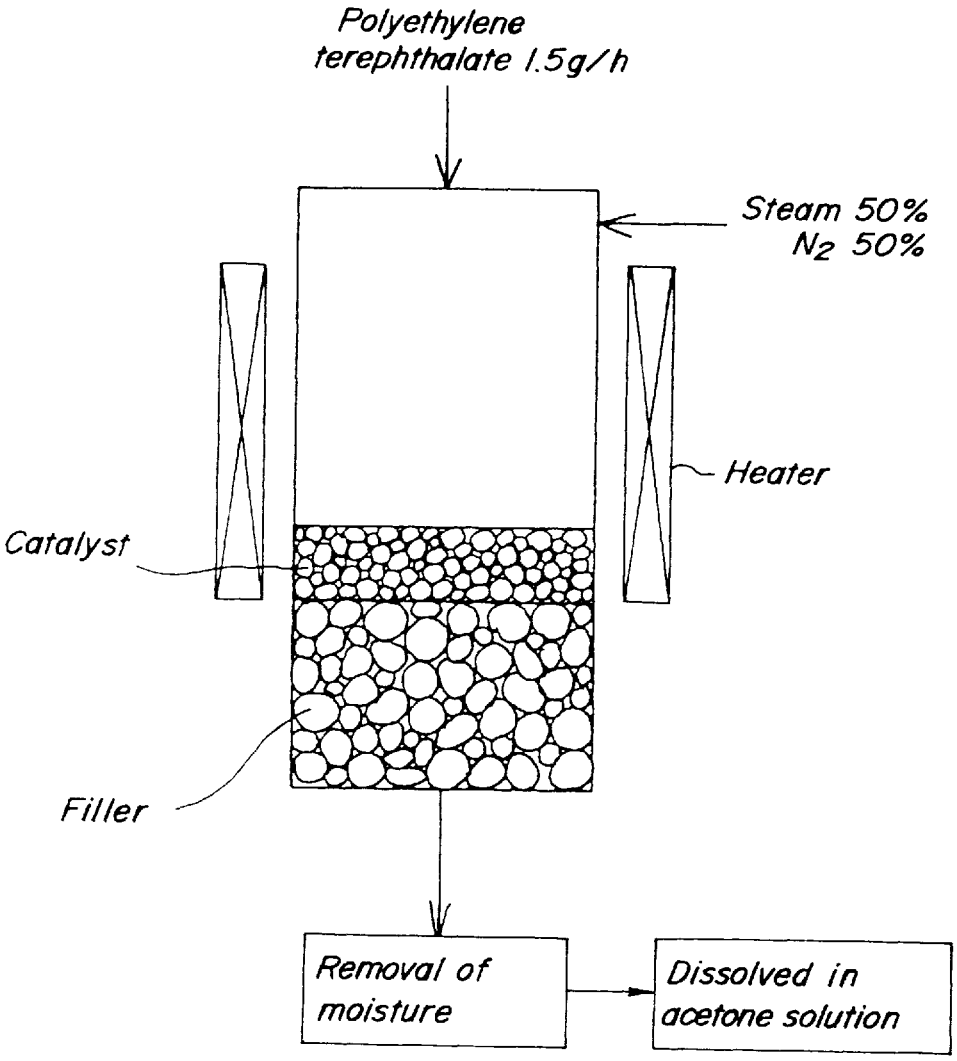
FIGS. 8 through 10 show trickle bed pyrolysis reactors used in Examples 3, 4 and 5, respectively, in which a cracked percentage of terephthalic acid was examined.
Figure 9:
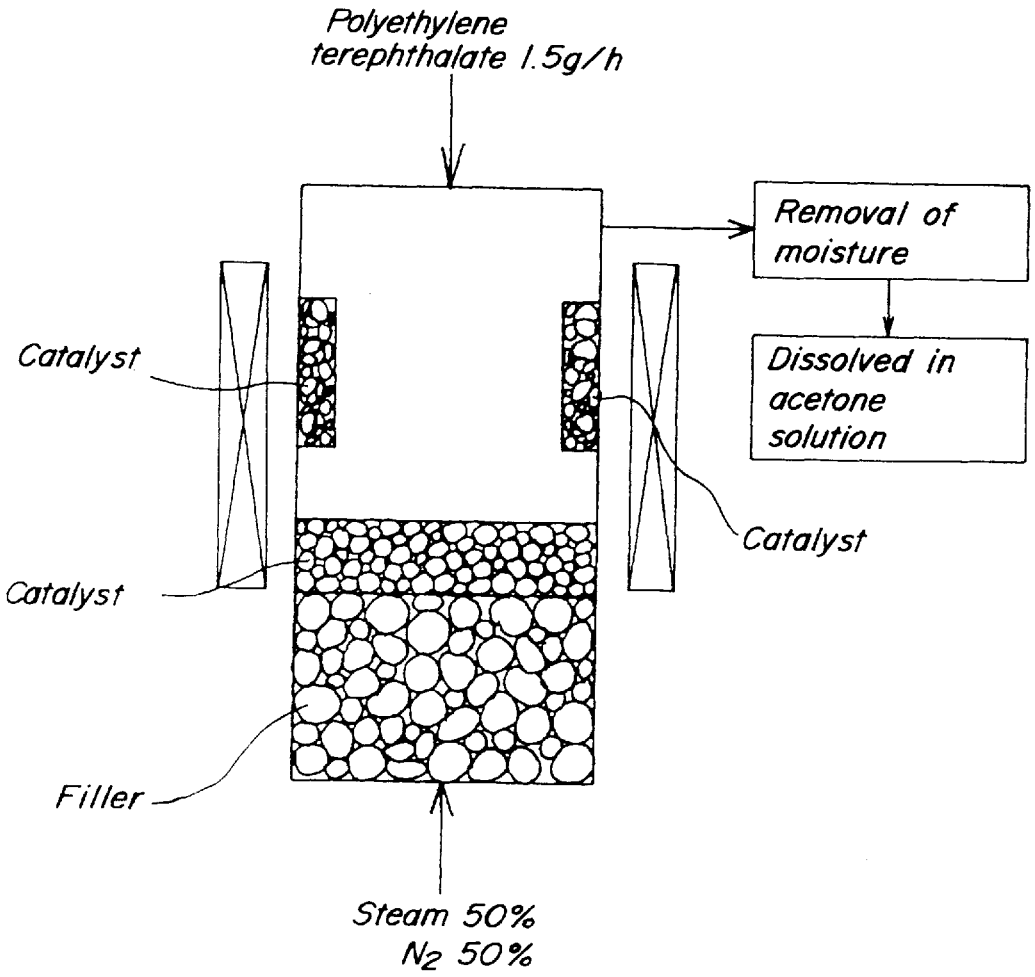
Figure 10:
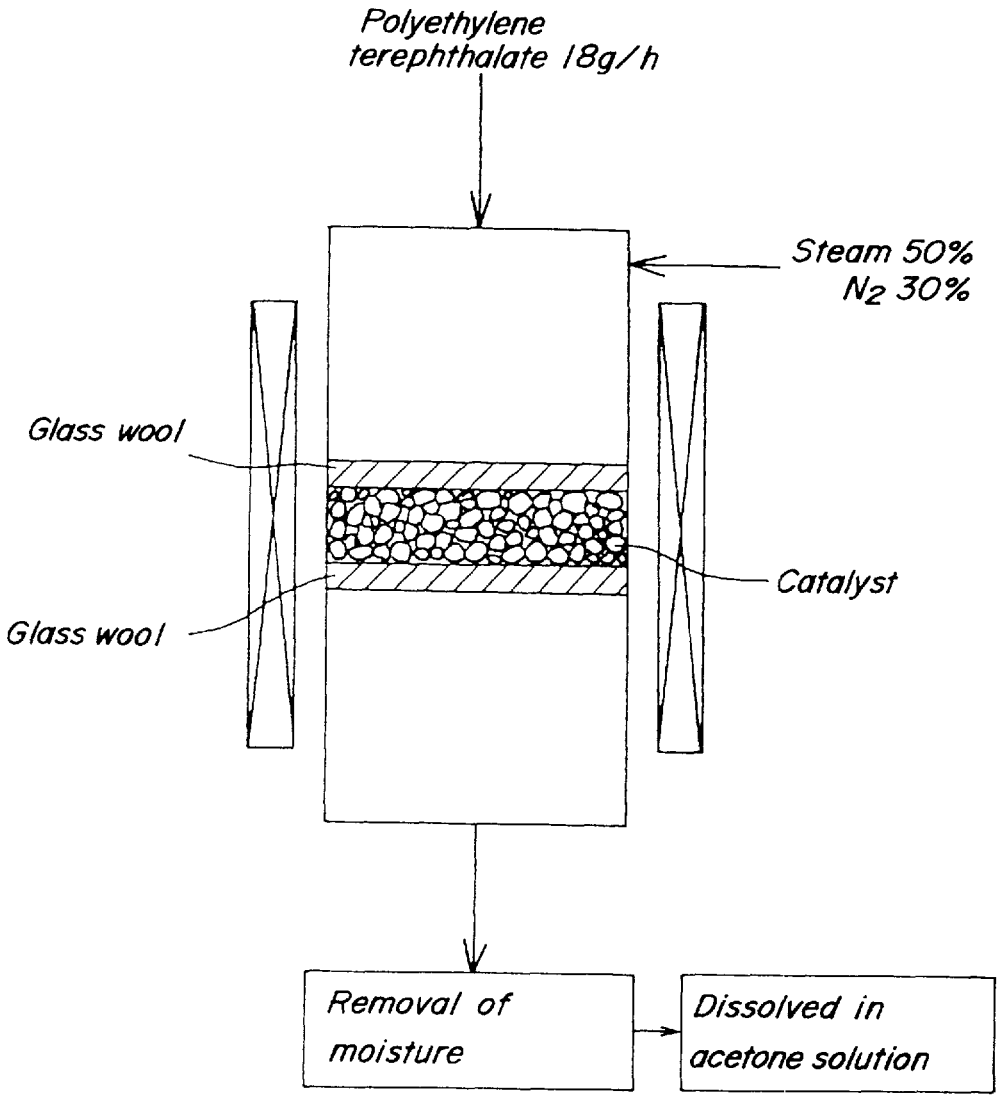

FIGS. 8 to 10 show pyrolysis reactors used in Examples 3 to 5, respectively. In FIGS. 8 and 9, a layer of a filler composed of large-diameter ceramic pieces is provided at a bottom portion in the pyrolysis reactor, and a layer of catalyst pellets is provided on the filler layer via a porous partition. A heater is provided outside the pyrolysis reactor, surrounding its outer peripheral portion corresponding to the catalyst layer and a space above the catalyst layer.

In the pyrolysis reactor of FIG. 10, a catalyst layer is provided in a central portion of the reactor, while its upper and lower end portions are fixedly held by glass wool. A heater is provided outside the pyrolysis reactor, surrounding its outer peripheral portion. By using these pyrolysis reactors, polyethylene terephthalate was fed into the pyrolysis reactor from an upper side, waste plastics was pyrolyzed in an atmosphere of a mixed gas of steam and an inert gas under heating with the heater, and a pyrolysis product was dissolved into acetone after moisture was removed by cooling with air.

The pyrolysis reaction was performed for a given time period, and the reaction was stopped. A phthalic sublimate deposited in the ceramic layer or the glass wool and a pipe line was washed with an alkaline solution, and precipitated again by neutralization. Then, the precipitate was washed and dried, and its weight was measured. In each example, no phthalic sublimate entered the acetone solution. The cracked rate of terephthalic acid was calculated according to the following equation. The content of terephthalic acid means a theoretical amount of terephthalic acid produced on the assumption that terephthalic acid is not cracked.

$$\text{Cracked rate of terephthalic acid (\%)} = \{1 - (\text{captured amount of terephthalic acid}/\text{content of terephthalic acid in original resin})\} \times 100$$

In the following, Examples 3 to 5 will be explained in more detail.

Example 3

A product oil was obtained by treating polyethylene terephthalate according to the procedure shown in FIG. 2 by using the trickle bed pyrolysis reactor shown in FIG. 8. The reaction temperature was 450° C. A mixed gas composed of 50 mol % of steam and 50 mol % of nitrogen gas was fed as a carrier gas at a rate of 98.7 cc/min. (450° C.). The product oil obtained after removal of moisture was dissolved into an acetone solution. The cracked rate of terephthalic acid was calculated according to the above-mentioned equation. Results are shown in Table 1, which confirms that the light-weight oil having a high addition value could be obtained by the invention process. In the invention process, the percentage of carbonaceous residue produced was not more than 1%.

TABLE 1

| Catalyst | Addition amount | Cracked rate of terephthalic acid | Product detected |
|---|---|---|---|
| $Fe(OH)_3$ | 3 g | not less than 99% | $C_6H_6$ (benzene) |
| $Fe_2O_3$ | 3 g | 34% | $C_6H_6$ (benzene) |
| no | — | 21% | $C_{11}H_{14}O_3$ (very small amount, intermediate reaction product) |

Example 4

The same treatment as in Example 3 was operated by using the trickle bed pyrolysis reactor shown in FIG. 9. As a result, when $Fe_2O_3$ (3 g) was used as a catalyst, the cracked rate of terephthalic acid was 23%, and a product detected was $C_{11}H_{14}O_3$ (very small amount, an intermediate reaction product). As compared with a case where the cracked rate of terephthalic acid was 20% with no use of a catalyst, it was confirmed that the excellent effect can be obtained by the invention process. Further, comparison between Example 3 revealed that the cracking of terephthalic acid more proceeds when the carrier gas is flown in parallel to the plastic. In the invention process, the percentage of carbonaceous residue produced was not more than 1%.

Example 5

The cracked rate of terephthalic acid was examined in the same manner as in Example 3 by using the trickle bed pyrolysis reactor in which the catalyst was held between the glass wool as shown in FIG. 10 under the condition that the reaction temperature was 450° C., and a mixed gas composed of 70 mol % of steam and 30 mol % of nitrogen gas was fed at a rate of 98.7 cc/min. (450° C.) as a carrier gas. Results are as shown in Table 2. It was confirmed that the light-weight oil having a high addition value can be obtained by the invention process. In the invention process, the percentage of carbonaceous residue produced was not more than 1%.

TABLE 2

| Catalyst | Addition amount | Cracked rate of terephthalic acid | Product detected |
|---|---|---|---|
| $Fe(OH)_3$ | 4 g | 84% | $C_6H_6$ (benzene) |
| " | 8 g | 98% | $C_6H_6$ (benzene) |
| " | 12 g | not less than 99% | $C_6H_6$ (benzene) |
| Iron ore produced at Lob River | 9 g | 66% | $C_6H_6$ (benzene) |
| Iron ore produced at Lob River | 18 g | 93% | $C_6H_6$ (benzene) |
| Lob River Iron ore produced at Lob River | 27 g | 98% | $C_6H_6$ (benzene) |

As is clear from the foregoing explanation, according to the present invention, even if the waste plastics contains phthalic polyester and/or polyvinyl chloride, the production of the phthalic sublimate and carbonaceous residue in the pyrolysis step can be almost eliminated, and the light-weight oil having a high octane number can be produced at a high yield. Therefore, the present invention extremely largely contributes to the development of the industries as the process for producing the light-weight oil from the waste plastics containing phthalic polyester and/or polyvinyl chloride while sweeping off the conventional problems.

What is claimed is:

1. A process for producing light-weight oil from waste plastics containing a phthalic polyester and/or a polyvinyl chloride comprising pyrolyzing said waste plastics in the presence of at least one material selected from the group consisting of iron hydroxide, hydrous iron oxide, and iron oxide in an atmosphere of steam or a mixture of steam and an inert gas to produce said light-weight oil.

2. The process for producing light-weight oil from the waste plastics containing the phthalic polyester and/or the polyvinyl chloride set forth in claim 1, wherein the pyrolysis is performed in a trickle bed pyrolysis reactor filled with a solid filler.

3. The process for producing light-weight oil from the waste plastics containing the phthalic polyester and/or the polyvinyl chloride set forth in claim 2, wherein the filler filled in the trickle bed pyrolysis reactor has one or more kinds of iron hydroxide, hydrous iron oxide and iron oxide present at at least a surface thereof.

4. The process for producing light-weight oil from the waste plastics containing the phthalic polyester and/or the polyvinyl chloride set forth in claim 2, wherein iron ore is used as the filler filled in the trickle bed pyrolysis reactor.

5. The process for producing light-weight oil from the waste plastics containing the phthalic polyester and/or the polyvinyl chloride set forth in claim 2, wherein after the filler filled in the trickle bed pyrolysis reactor is discharged outside from the reactor together with a residue, the residue is removed and the filler is fed to the reactor.

6. The process for producing light-weight oil from the waste plastics containing the phthalic polyester and/or the polyvinyl chloride set forth in claim 1, wherein a pyrolysis oil or a mixture of the pyrolysis oil and a pyrolyzed gas obtained by the pyrolysis of the waste plastics containing the phthalic polyester and/or the polyvinyl chloride is catalytically cracked in an atmosphere of steam or a mixture of steam and an inert gas by using a catalyst.

7. The process for producing light-weight oil from the waste plastics containing the phthalic polyester and/or the polyvinyl chloride set forth in claim 6, wherein the catalytic cracking is performed with a catalyst of rare earth metal exchanged Y type zeolite.

8. The process for producing light-weight oil from the waste plastics containing the phthalic polyester and/or the polyvinyl chloride set forth in claim 7, wherein the rare earth metal-exchanged Y type zeolite is Y type zeolite supporting a transition metal.

9. The process for producing light-weight oil from the waste plastics containing the phthalic polyester and/or the polyvinyl chloride set forth in claim 8, wherein the transition metal is nickel.

10. The process for producing light-weight oil from the waste plastics containing the phthalic polyester and/or the polyvinyl chloride set forth in claim 1, wherein before the pyrolysis is performed, the waste plastics containing the phthalic polyester and/or the polyvinyl chloride are dechlorinated.

11. The process for producing light-weight oil from the waste plastics containing the phthalic polyester and/or the polyvinyl chloride set forth in claim 10, wherein the dechlorination is performed in an atmosphere of steam and/or a mixture of steam and an inert gas.

12. The process for producing light-weight oil from the waste plastics containing the phthalic polyester and/or the polyvinyl chloride set forth in claim 10, wherein the dechlorination is performed in a moving bed reactor, and after the dechlorination is completed, the waste plastics and a filler is transferred to a pyrolysis reactor, and after the pyrolysis is completed, the filler is discharged outside from the reactor together with a residue, and after the residue is removed, the filler is fed to a dechlorinating reactor.

13. The process fof producing light-height oil from the waste plastics containing the phthalic, polyester and/or the polyvinyl chloride set forth in claim 12, wherein a ceramic filler is used as the filler.

14. The process for producing light-weight oil from the waste plastics containing the phthalic polyester and/or the polyvinyl chloride set forth in claim 13, wherein an alumina filler is used as the filler.

15. The process for producing light-weight oil from the waste plastics containing the phthalic polyester and/or the polyvinyl chloride set forth in claim 1, wherein a combustion exhaust gas of a pyrolyzed gas is used as the inert gas.

16. A process for producing light-weight oil from waste plastics containing a phthalic polyester and/or a polyvinyl chloride comprising pyrolyzing said waste plastics in an atmosphere of steam or a mixture of steam and an inert gas to produce a light weight oil containing a phthalic sublimate and thereafter cracking said phthalic sublimate in the presence of at least one material selected from the group consisting of iron hydroxide, hydrous iron oxide, and iron oxide.

17. The process for producing light-weight oil from the waste plastics containing the phthalic polyester and/or the polyvinyl chloride set forth in claim 16, wherein after the phthalic sublimate cracking, a catalytic cracking is performed with a catalyst of Y type zeolite.

18. The process of claim 16, wherein the pyrolyzing step is carried out in a trickle bed pyrolysis reactor filled with a solid filler.

19. The process of claim 18, wherein the filler in the trickle bed pyrolysis reactor has at least one of iron hydroxide, hydrous iron oxide, and iron oxide present on at least a surface thereof.

20. The process of claim 18, wherein the filler in said trickle bed pyrolysis reactor is iron ore.

* * * * *